US011850882B2

(12) United States Patent
Stevenson et al.

(10) Patent No.: US 11,850,882 B2
(45) Date of Patent: Dec. 26, 2023

(54) DECORATIVE DOOR WREATH

(71) Applicants: Rashad M Stevenson, Gretna, LA (US); Ashley L Stevenson, Gretna, LA (US)

(72) Inventors: Rashad M Stevenson, Gretna, LA (US); Ashley L Stevenson, Gretna, LA (US)

( * ) Notice: Subject to any disclaimer, the term of this patent is extended or adjusted under 35 U.S.C. 154(b) by 37 days.

(21) Appl. No.: 18/084,355

(22) Filed: Dec. 19, 2022

(65) Prior Publication Data

US 2023/0116938 A1 Apr. 20, 2023

(51) Int. Cl.
*B44C 5/06* (2006.01)
*B44C 5/04* (2006.01)

(52) U.S. Cl.
CPC ..... *B44C 5/06* (2013.01); *B44C 5/0446* (2013.01)

(58) Field of Classification Search
CPC ..... B44C 5/06; B44C 5/0446
See application file for complete search history.

(56) References Cited

U.S. PATENT DOCUMENTS 4,966,344 A * 10/1990 Gary ..... F16B 2/22 248/214
5,789,043 A * 8/1998 Law ..... G09F 19/08 428/10
6,592,952 B1 * 7/2003 Ferguson ..... G09F 19/00 428/7
2018/0293916 A1 * 10/2018 Tetreault ..... A01G 5/04
2021/0215328 A1 * 7/2021 McNamara ..... F21V 23/06
2023/0087386 A1 * 3/2023 Limber ..... F21V 21/088 248/74.2

* cited by examiner

*Primary Examiner* — Mary Ellen Bowman
(74) *Attorney, Agent, or Firm* — Norton IP Law Firm LLC; Taylor M. Norton

(57) ABSTRACT

A decorative door wreath having an annular ring and at least a first decorative ornament detachably attached to the annular ring is disclosed. The annular ring includes a front annular planar body and a back annular support base. The front annular planar body includes a front surface disposed between a continuous inner edge opposite a continuous outer edge. The back annular support base has a smaller width than a width of the front annular planar body. The first retention member includes a first base plate and a first pair of resiliently flexible spring arms removably connected to the front surface of the front annular planar body. The first pair of resiliently flexible spring arms flex laterally to provide for passage of at least a first portion of the front annular planar body therebetween. The at least first decorative ornament is detachably coupled to and retained by the annular ring.

23 Claims, 8 Drawing Sheets

DECORATIVE DOOR WREATH

BACKGROUND OF THE INVENTION

Field of the Invention

The present invention generally relates to decorative devices and more particularly relates to decorative door wreath devices with interchangeable ornaments.

Description of the Related Art

Decoration elements such as door wreaths are often a common way to embellish or decorate the entrance of a house, apartment or office. Presently, in festivals, decorations are often hung on the door of a house for increasing festival atmosphere. For example, during Christmas season, or in the Spring time, Christmas decorations or seasonally festive decorative door wreaths are hung on the door.

Generally, such door wreaths consist of a round arrangement of, for example, branches and are decorated with loops, balls, figures or the like. The shapes, colors and materials of conventional door wreaths can be very different depending upon preferences of each individual.

Various type of material may be used to make wreaths such as wood, plastic, rubber, glass and the like. Lighted wreaths are also available in the market to provide ethereal effect. However, most of the available wreaths have a static ornamental design and, often times, a user gets bored with seeing the same ornamental design on the door for too long of a time or when the season changes.

Conventionally, people have to spend money to buy a new wreath to have a new ornamental design. Therefore, a need exists for decorative door wreath device that facilitate attachment of interchangeable ornaments. Further, the new and improved door wreath devices should include retention members to facilitate attachment of detachable ornaments, where the decorative door wreaths are comparatively of simple construction and arrangement, and where the decorative door wreaths are strong, durable, and efficient in its use.

A need therefore exists for a decorative door wreath capable of universal application. Accordingly, there is a need for a decorative door wreath having decorative ornaments that may be easily positioned and/or repositioned at the option and intention of the user without complex assembly and setup.

As disclosed in this application, the inventors have discovered novel and unique devices and methods for decorating with door wreaths, which exhibit superlative properties without being dependent on heavy, immobile, components.

The devices disclosed herein avoid many of the drawbacks of existing devices which rely on expensive complexities or complex tools for application of the devices to the door.

Embodiments of the present invention provide for decorative door wreaths as described and defined in the description below and in the annexed claims which provide for improved mobility, setup, and retention characteristics in order to efficiently interchange decorative ornaments of various sizes of interest in a multitude of environments.

SUMMARY OF THE INVENTION

It is one prospect of the present invention to provide a novel decorative door wreath of simple but effective construction which can be applied to nearly any door to securely and efficiently retain decorative ornaments of different sizes and shapes.

It is also an aim of the present invention to provide an improved decorative door wreath having an annular ring and at least a first decorative ornament detachably attached to the annular ring.

The annular ring includes a front annular planar body and a back annular support base. The front annular planar body includes a front surface disposed between a continuous inner edge opposite a continuous outer edge. The back annular support base includes a smaller width than a width of the front annular planar body.

The first decorative ornament is fixed to at least a first retention member. The first retention member includes a first base plate and a first pair of resiliently flexible spring arms removably connected to the front surface of the front annular planar body. The first pair of resiliently flexible spring arms are configured to flex laterally away from each other in opposing directions to provide for passage of at least a first portion of the front annular planar body therebetween.

The first pair of resiliently flexible spring arms retract back into position so as to contract around the continuous inner edge and the continuous outer edge of the at least first portion of the front surface of the annular ring. The at least first decorative ornament extends frontally from the annular ring while the at least first decorative ornament is detachably coupled to and retained by the annular ring.

Another object of the present invention is to provide the first base plate of the at least first retention member includes either a rectangular planar body or a round planar body.

Yet another object of the present invention is to provide the decorative door wreath where each resiliently flexible spring arm of the first pair of resiliently flexible spring arms having a planar body extending outwardly transverse from the first base plate of the at least first retention member. Each resiliently flexible spring arm has a distal end having an inwardly facing protuberance adapted to contract around the continuous inner edge and the continuous outer edge of the at least second portion of the front surface of the annular ring.

Yet another object of the present invention is to provide first decorative ornament fixed to at least a second retention member having a second base plate and a second pair of resiliently flexible spring arms removably connected to the front surface of the front annular planar body. The second pair of resiliently flexible spring arms are configured to flex laterally away from each other in opposing directions to provide for passage of at least a second portion of the front annular planar body therebetween. The second pair of resiliently flexible spring arms then retract back into position so as to contract around the continuous inner edge and the continuous outer edge of the at least second portion of the front surface of the annular ring. The at least first decorative ornament extends frontally from the annular ring while the at least first decorative ornament is detachably coupled to and retained by the annular ring.

Yet another object of the present invention is to provide the decorative door wreath wherein the first portion of the front surface of the annular ring is disposed on an opposite side of the annular ring than the second portion of the front surface of the annular ring.

Yet another object of the present invention is to provide the decorative door wreath where at least one of the first decorative ornament and the second decorative ornament is either molded in the shape of a seasonal signage with a display of at least one word, shape of a logo, a mascot, or a name of a school or of a team or is constructed in the shape of a flower.

Yet another object of the present invention is to provide the decorative door wreath with at least a second decorative ornament fixed to at least a third retention member having a third base plate and a third pair of resiliently flexible spring arms removably connected to the front surface of the front annular planar body. The third pair of resiliently flexible spring arms are configured to flex laterally away from each other in opposing directions to provide for passage of at least a third portion of the front annular planar body therebetween. The third pair of resiliently flexible spring arms are retracted back into position so as to contract around the continuous inner edge and the continuous outer edge of the at least third portion of the front surface of the annular ring. The at least second decorative ornament extends frontally from the annular ring while the at least second decorative ornament is detachably coupled to and retained by the annular ring.

Yet another object of the present invention is to provide the decorative door wreath where the annular ring defines at least a first plurality of mounting apertures in a spaced-relationship with respect to each other around a circumference of the annular ring. Each mounting aperture is adapted to receive a bendable wire frame of at least one wire frame mounted decorative ornament.

Yet another object of the present invention is to provide the decorative door wreath with at least one wire frame mounted decorative ornament fixed to a bendable wire frame. The bendable wire frame is removably connected to the planar annular ring. The bendable wire frame is removably disposed through at least one mounting aperture of the at least first plurality of mounting apertures of the annular ring.

Yet another object of the present invention is to provide the decorative door wreath with a plurality of light emitting diodes (LEDs) disposed either around a continuous outer surface or continuous inner surface of the back annular support base. The plurality of light emitting diodes (LEDs) electrically connected to a power source. Further, the power source is a battery disposed within a recess defined by the back annular support base.

Yet another object of the present invention is to provide the decorative door wreath where the annular ring is made either of a composite material, a metal, a metal alloy material, or a single piece of unitary construction.

Yet another object of the present invention is to provide the decorative door wreath with a hanger to be adapted on a door. The hanger includes a vertical arm sliding into a slot defined by the back annular support base. Further, the decorative door wreath includes a hanger slot on the back annular support base to receive the hanger.

Additional objects, advantages and novel features of this invention shall be set forth in the description that follows, and in part will become apparent to those skilled in the art upon examination of the following specification and claims of my invention. The objects and advantages of the invention may be realized and attained by means of the instrumentalities, combinations, and devices particularly pointed out in the appended claims.

The following presents a simplified summary of the present disclosure in a simplified form as a prelude to the more detailed description that is presented herein.

Therefore, to achieve the foregoing and other objects and in accordance with the purposes and embodiments of the present invention, as embodied and described herein, there is provided a decorative door wreath.

These and other features, aspects, and advantages of the present invention will become better understood with reference to the following description and appended claims.

BRIEF DESCRIPTION OF THE DRAWINGS

Illustrative embodiments of the present invention are described herein with reference to the accompanying drawings, in which.

DETAILED DESCRIPTION

Figure 1:
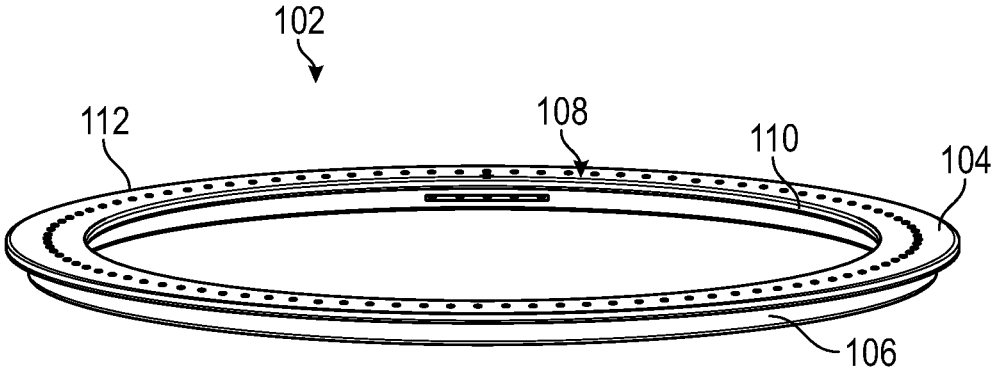
FIG. 1 is a front bottom perspective view of an annular ring, in accordance with embodiments of the invention.

For a further understanding of the nature and function of the embodiments, reference should be made to the following detailed description. Detailed descriptions of the embodiments are provided herein, as well as, the best mode of carrying out and employing the present invention. It will be readily appreciated that the embodiments are well adapted to carry out and obtain the ends and features mentioned as well as those inherent herein. It is to be understood, however, that the present invention may be embodied in various forms. Therefore, persons of ordinary skill in the art will realize that the following disclosure is illustrative only and not in any way limiting, as the specific details disclosed herein provide a basis for the claims and a representative basis for teaching to employ the present invention in virtually any appropriately detailed system, structure or manner. It should be understood that the devices, materials, methods, procedures, and techniques described herein are presently representative of various embodiments. Other embodiments of the disclosure will readily suggest themselves to such skilled persons having the benefit of this disclosure.

For purposes of clarity and orientation with respect to a person, referred to herein as a user, it is noted that a transverse (also known as axial or horizontal) plane is an X-Z plane, parallel to the ground. A frontal (also known as coronal) plane is a Y-X plane, perpendicular to the ground, which separates the anterior from the posterior, the front from the back. A sagittal (also known as lateral) plane is an Y-Z plane, perpendicular to the ground, which separates left from right. Objects are coplanar if they all lie in the same plane. For example, one axis is coplanar with another axis when the two axes lie in the same plane.

As used herein, "axis" means a real or imaginary straight line about which a three-dimensional body is symmetrical. A "vertical axis" means an axis perpendicular to the ground (or put another way, an axis extending upwardly and downwardly). A "horizontal axis" means an axis parallel to the ground.

As used herein, homogeneous is defined as the same in all locations, and a homogeneous material is a material of uniform composition throughout that cannot be mechanically separated into different materials. Examples of "homogeneous materials" are certain types of plastics, ceramics, glass, metals, alloys, paper, board, resins, and coatings.

Reference will now be made in detail to the present preferred embodiments of the invention, examples of which are illustrated in the accompanying drawings. Wherever possible, the same reference numerals are used in the drawings and the description to refer to the same or like parts.

Referring initially to FIGS. 1 to 13, a decorative door wreath 100 is disclosed. The decorative door wreath 100 is shown in FIG. 6 and FIG. 13 in accordance with preferred embodiments of the present invention. The decorative door wreath 100 includes an annular ring 102 and at least a first decorative ornament 103. FIG. 1 illustrates a side perspective view of an annular ring 102. The annular ring 102 comprises a front annular planar body 104 and a back annular support base 106.

The front annular planar body 104 includes a front surface 108 disposed between a continuous inner edge 110 opposite a continuous outer edge 112. In a preferred embodiment, the back annular support base 106 includes a smaller width than a width of the front annular planar body 104. The first decorative ornament 103 is fixed to a first retention member 114. The decorative ornament 103 is shown and explained in FIG. 6 and FIG. 13 of the present invention.

Figure 2:
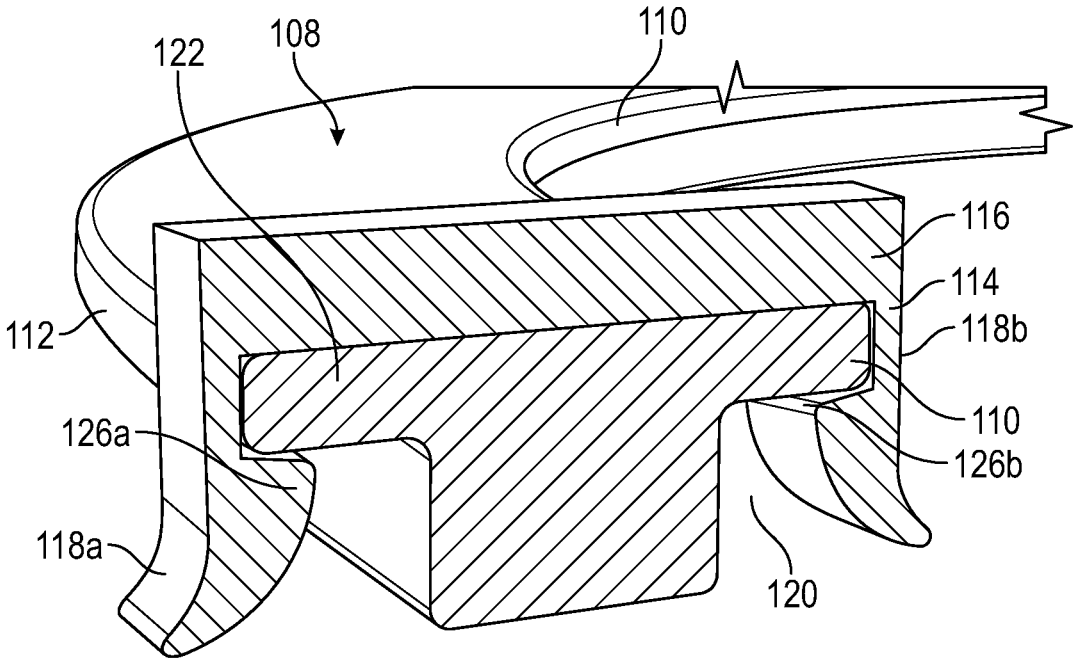
FIG. 2 is a cross-section view along cutting view 2-2 of FIG. 5 of a first retention member attached to the annular ring, in accordance with embodiments of the invention.

FIG. 2 is a cross-section view of the first retention member 114 attached to the annular ring 102. The first retention member 114 includes a first base plate 116 and a first pair of resiliently flexible spring arms 118*a*, 118*b* removably connected to the front surface 108 of the front annular planar body 104.

As exemplified in FIGS. 2-5 and 8, the first pair of resiliently flexible spring arms 118*a*, 118*b* are configured to flex laterally away from each other in opposing directions to provide for passage 120 of at least a first portion 122 of the front annular planar body 104 therebetween. The first pair of resiliently flexible spring arms 118*a*, 118*b* then retracts back into position so as to contract around the continuous inner edge 110 and the continuous outer edge 112 of the at least first portion of the front surface 108 of the annular ring 102.

Figure 3:
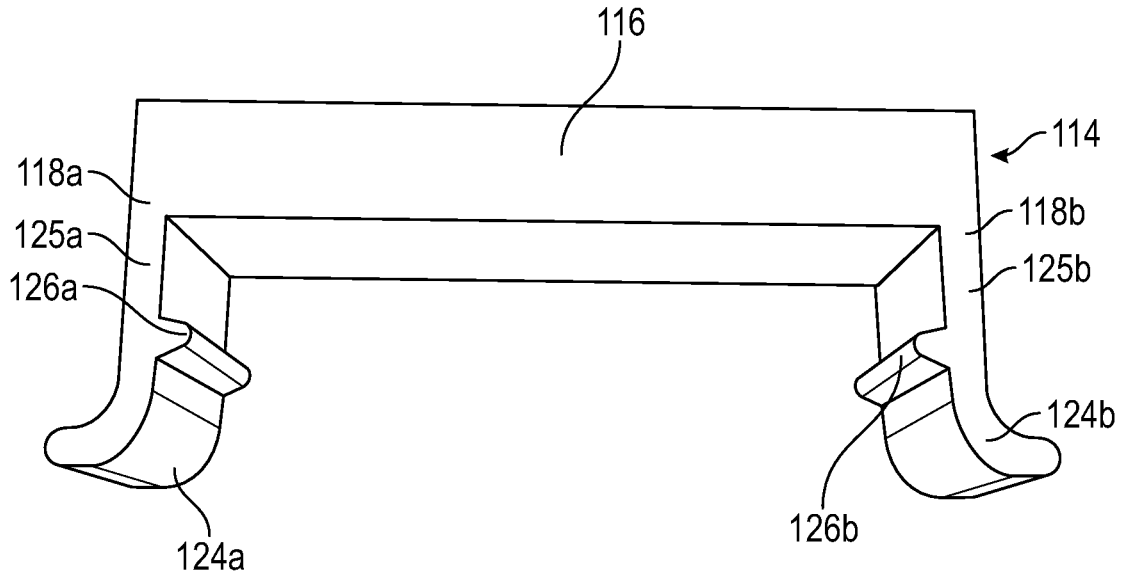
FIG. 3 is a front view of the first retention member, in accordance with other embodiments of the invention.

FIG. 3 provides a front view of the first retention member 114, in accordance one with embodiment of the invention. Each resiliently flexible spring arm 118*a*, 118*b* of the first pair of resiliently flexible spring arms 118*a*, 118*b* includes a respective planar body 125*a*, 125*b* extending outwardly transverse from the first base plate 116 of the at least first retention member 114.

In a preferred embodiment, each resiliently flexible spring arm 118*a*, 118*b* has a distal end 124*a*, 124*b*, respectively, preferably comprising an inwardly facing protuberance 126*a*, 126*b*, each respective inwardly facing protuberance 126*a*, 126*b* being sized and configured to contract around the continuous inner edge 110 and the continuous outer edge 112, respectively, of the at least second portion (128, shown in FIG. 5) of the front surface 108 of the annular ring 102. In one embodiment, the first base plate 116 of the at least first retention member 114 includes a rectangular planar body.

Figure 4:
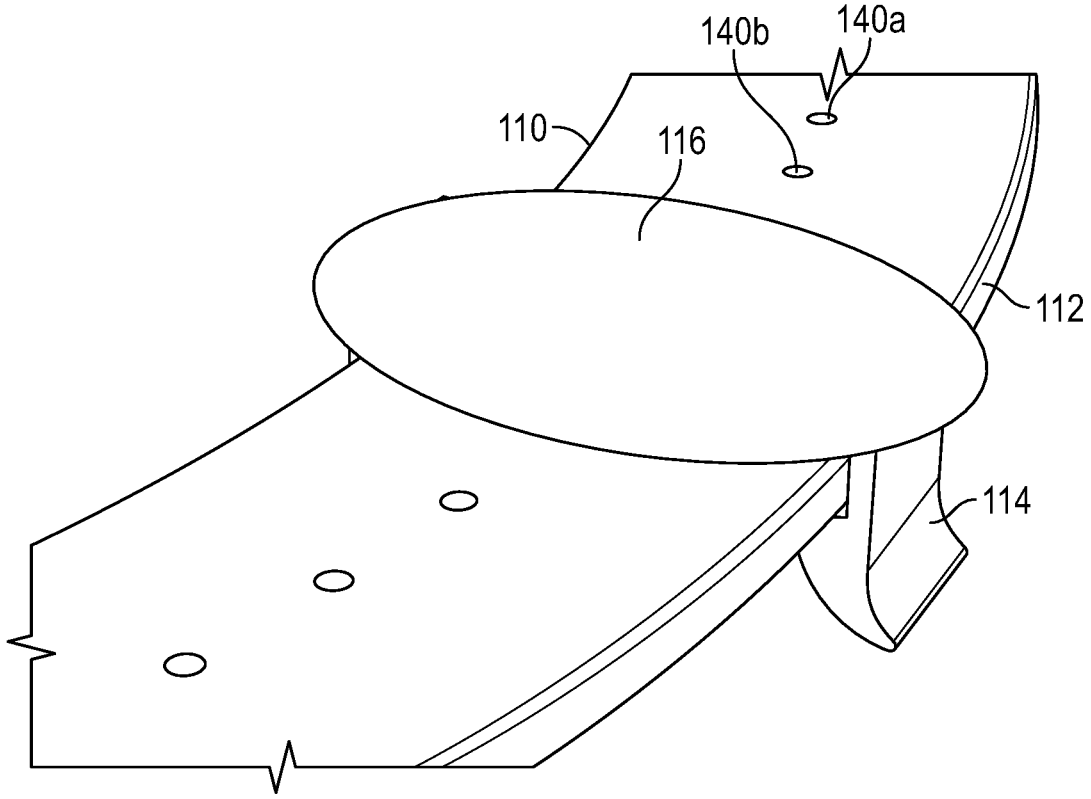
FIG. 4 is a perspective view of the first retention member, in accordance with other embodiments of the invention.

FIG. 4 provides a perspective view of the first retention member 114. As illustrated in FIG. 4, in one embodiment, the first base plate 116 preferably comprises a round planar body, which is preferably fixed to a decorative ornament, such as the at least first decorative ornament 103 (e.g., flowers) or the at least second decorative ornament 138 (e.g., Welcome sign), in accordance with embodiments of the invention.

Figure 5:
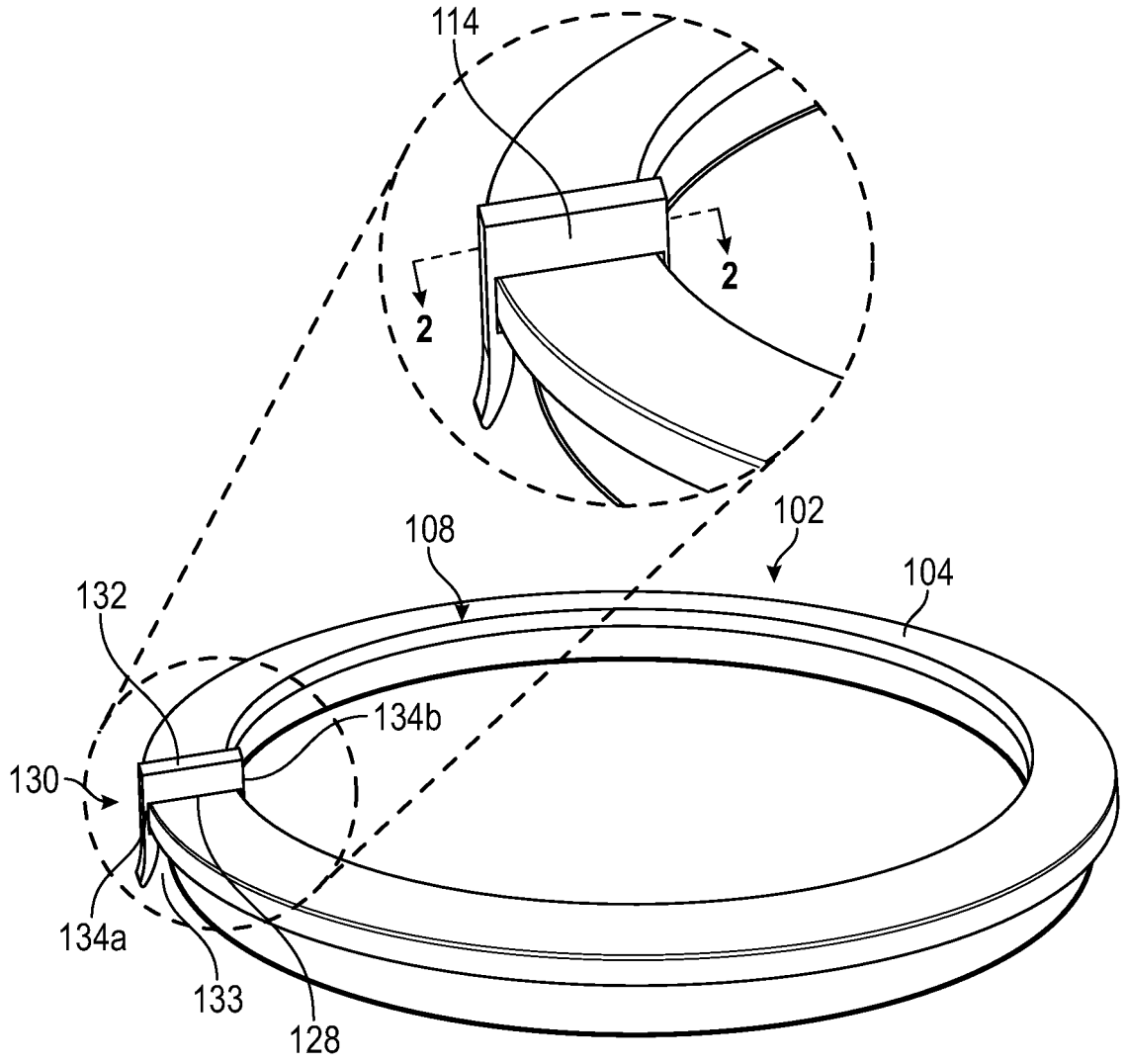
FIG. 5 is a perspective of the annular ring, in accordance with embodiments of the invention.
Figure 6:
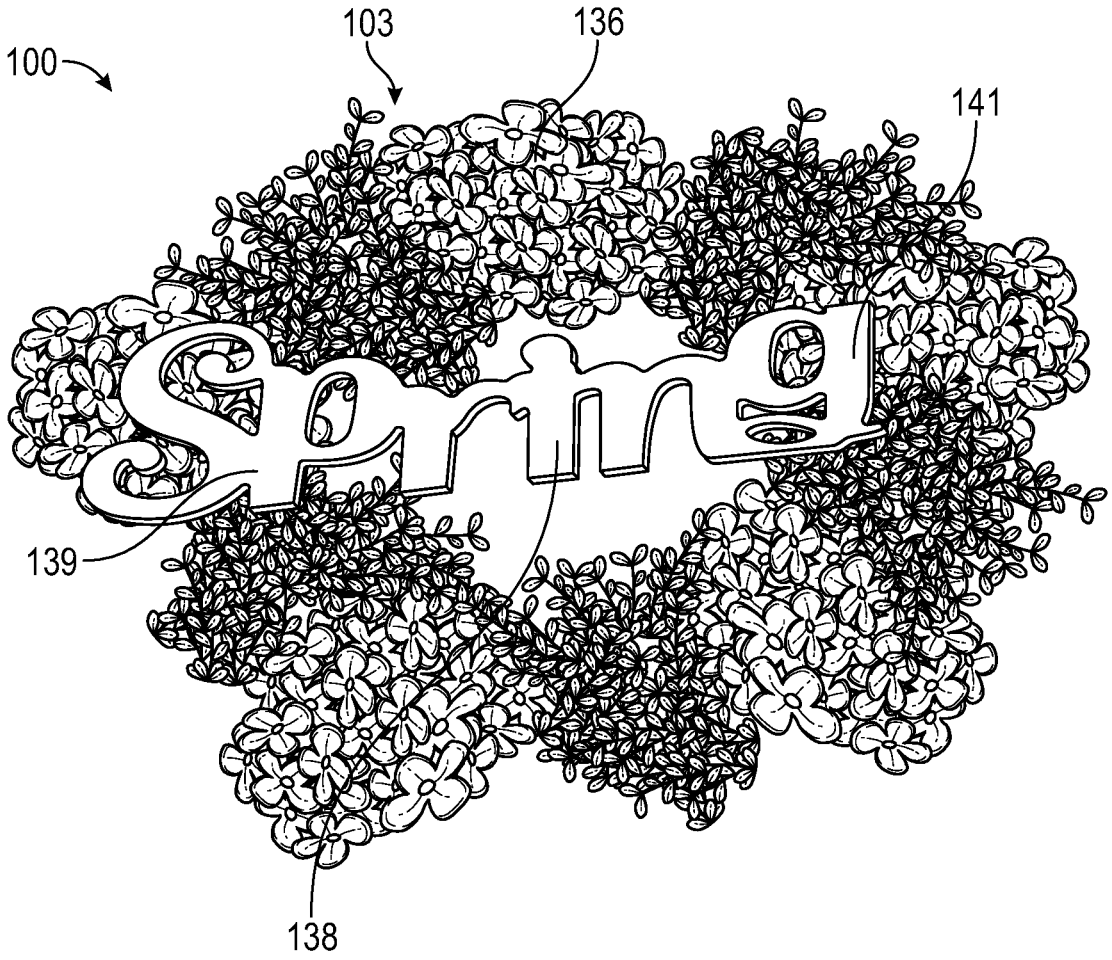
FIG. 6 is a front perspective view of a first decorative ornament, in accordance with embodiments of the invention.

FIG. 5 provides a perspective of the annular ring 102 in accordance with embodiments of the disclosed invention. As illustrated in FIG. 5, the first decorative ornament (103, shown in FIG. 6) is fixed to at least a second retention member 130. The second retention member 130 includes a second base plate 132 and a second pair of resiliently flexible spring arms 134*a*, 134*b*. The second pair of resiliently flexible spring arms 134*a*, 134*b* are removably connected to the front surface 108 of the front annular planar body 104, as shown in FIG. 5.

The second pair of resiliently flexible spring arms 134*a*, 134*b* of the at least second retention member 130 are configured to flex laterally away from each other in opposing directions. The second pair of resiliently flexible spring arms 134*a*, 134*b* flex outwardly to provide for a passage 133 of at least a second portion 128 of the front annular planar body 104.

As exemplified in FIGS. 5-6, in a preferred embodiment, the first portion 122 of the front surface 108 of the annular ring 102 is disposed on an opposite side of the annular ring 102 than the second portion 128 of the front surface 108 of the annular ring 102.

FIG. 6 is a front perspective view illustrating the at least first decorative ornament 103 as attached to the annular ring 102 of the decorative door wreath 100, in accordance with embodiments of the invention. The first decorative ornament 103 is fixed to the at least first retention member 114 (shown in FIG. 2, FIG. 4 and FIG. 5). The at least first decorative ornament 103 extends frontally from the annular ring 102 as shown in FIG. 2 and FIG. 5. As fixed to the at least a first retention member 114, the at least first decorative ornament 103 is detachably coupled to and retained by the annular ring 102, as exemplified in FIG. 2 and FIG. 5.

As shown in FIG. 6, as exemplary embodiment, the at least first decorative ornament 103 is constructed in the shape of a flower/leaves 136. Further, in one embodiment, at least a second decorative ornament 138 is molded in the shape of a seasonal signage, preferably having a display of at least one word. For exemplary purposes, as shown in FIG. 6, the seasonal signage is "Spring." In such embodiment, the at least second decorative ornament 138 has one end 139 fixed that is fixed to the at least second retention member 130, and the second decorative ornament 138 has an opposite end 141 fixed to at least a third retention member (having the same form and structure as the at least second retention member 130). The at least second retention member 130 and the at least third retention member are each removably connected to the front surface 108 of the annular ring 102. Accordingly, the at least first decorative ornament 103 is removably connected to the front surface 108 of the annular ring 102 of the decorative door wreath 100; and the at least second decorative ornament 138 is also removably connected to the front surface 108 of the annular ring 102. As can be appreciated form the disclosure herein, embodiments of the disclosed invention enable a user to easily interchange the decorative ornaments (e.g., 103, 138) as so desired, without needing to change out the door wreath.

In yet another embodiment, the first decorative ornament 103 and the second decorative ornament 138 are molded in the shape of a logo, a flower, a plant, an animal, a mascot, or a name of a school or of a team. It would be readily apparent to those skilled in the art that various shapes, sizes, verbiage and colors of the first decorative ornament 103 and the second decorative ornament 138 may be envisioned without deviating from the scope of the present invention.

In a preferred embodiment, the second decorative ornament 138 is removably attached via the second retention member 130 to the front annular planar body 104 of the annular ring 102. Further, in one embodiment, the second decorative ornament 138 is fixed to at least a third retention member (not shown in Figures). The third retention member includes a third base plate and a third pair of resiliently flexible spring arms removably connected to a third portion of the front surface of the front annular planar body 104. The third retention member, its third base plate, and its third pair of resiliently flexible spring arms are in the same form and structure of the first pair of first pair of resiliently flexible spring arms 118*a*, 118*b*, which are removably connected to the front surface 108 of the front annular planar body 104 of the annular ring 102.

The third pair of resiliently flexible spring arms are configured to flex laterally away from each other in opposing directions to provide for passage of at least the third portion of the front annular planar body 104 therebetween. The third pair of resiliently flexible spring arms then retract back into position so as to contract around the continuous inner edge and the continuous outer edge of the at least third portion of the front surface of the annular ring. Preferably, the third retention member is identical to the first retention member and the second retention member.

Referring to FIG. 6, in a preferred embodiment, the at least second decorative ornament 138 extends frontally from the annular ring 102 while the at least second decorative ornament 138 is detachably coupled to and retained by the annular ring 102, because the at least second decorative ornament 138 is fixed to the second base plate 132 of the second retention member 130 and is also fixed to the third base plate of the third retention member. It would be readily apparent to those skilled in the art that multiple retention members may be envisioned to attach multiple decorative ornaments on the annular ring, without deviating from the scope of the present invention.

Figure 7:
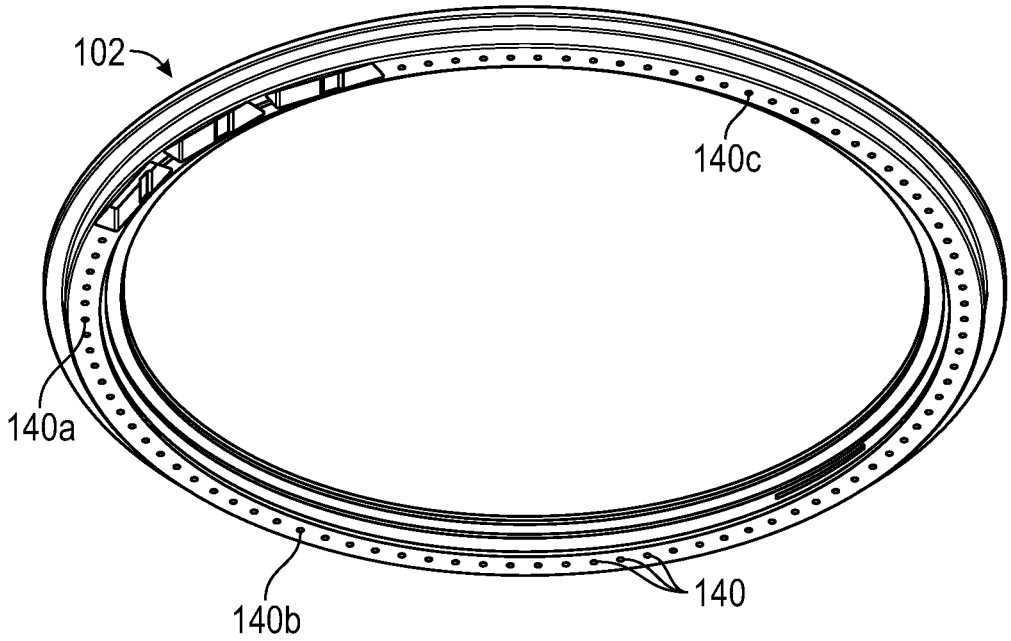
FIG. 7 is a rear perspective view of the annular ring, in accordance with embodiments of the invention.

FIG. 7 provides a rear perspective view of the annular ring 102, in accordance with embodiments of the invention. The annular ring 102 defines at least a first plurality of mounting apertures 140 such as 140*a*, 140*b*, 140*c* in a spaced-relationship with respect to each other around a circumference of the annular ring 102. The mounting aperture 140 is adapted to receive a bendable wire frame 144 (as shown in FIG. 8) of at least one wire frame mounted decorative ornament 145, as illustrated in FIG. 8.

Figure 8:
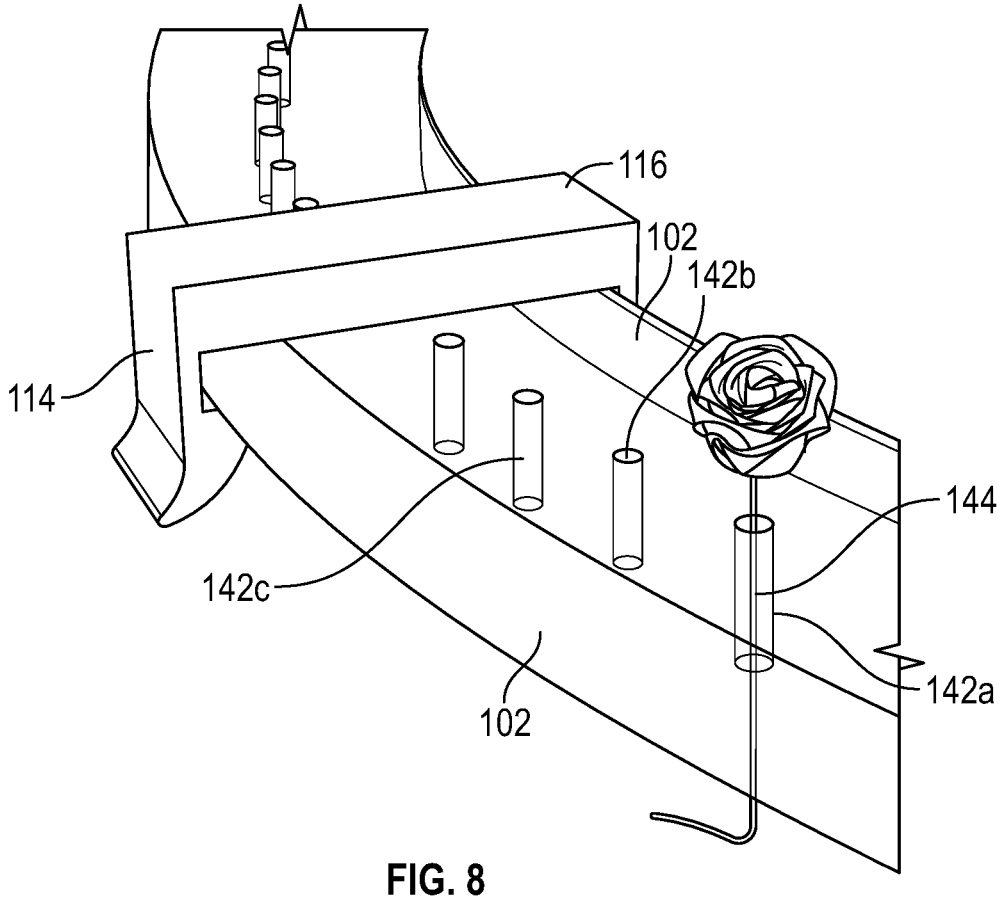
FIG. 8 is a top perspective view of the annular ring, in accordance with embodiments of the invention.

FIG. 8 provides a top perspective view of the annular ring 102, in accordance with embodiments of the invention. The at least one wire frame mounted decorative ornament 145 is fixed to the bendable wire frame 144. The bendable wire frame 144 is removably connected to the planar annular ring 102, as exemplified in FIG. 8.

As illustrated in FIG. 8, the bendable wire frame 144 is removably disposed through at least one mounting aperture 142*a* of the at least first plurality of mounting apertures 142 of the annular ring 102. As exemplified in FIG. 8, in one embodiment, the first decorative ornament 103 is a flower with a bendable wire frame 144. The bendable wire frame 144 is disposed in the mounting aperture 142, thereby removably connecting the first decorative ornament 103 to the annular ring 102 of the decorative door wreath 100. As can be appreciated from the disclosure herein, numerous different, decorative ornaments (e.g., 103) each having respective bendable wire frames (e.g., 144) can be removably connected to the respective mounting apertures (e.g., 142*a*, 142*b*, 142*c*) of the first plurality of mounting apertures 142. As such, a user can decorate the decorative door wreath 100 in a countless number of ways, interchanging the decorative ornaments at the option of the user, while obviating the need to purchase different door wreaths for different occasions.

Figure 9:
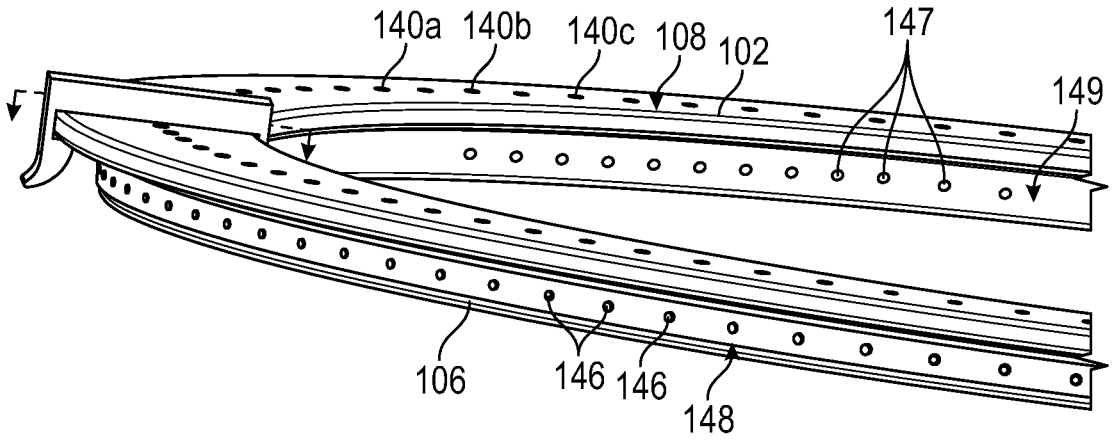
FIG. 9 is a side perspective view of plurality of LEDs attached to the annular ring, in accordance with embodiments of the invention.

FIG. 9 provides a side perspective view of a plurality of light emitting diodes (LEDs) 146 attached to the annular ring 102. In a preferred embodiment, the decorative door wreath 100 includes a first plurality of light emitting diodes (LEDs) 146 disposed around a continuous outer surface 148 of the back annular support base 106, as exemplified in FIG. 9. In another embodiment, the decorative door wreath 100 includes a first plurality of light emitting diodes (LEDs) 146 disposed around the front surface 108 of the front annular planar body 104. The first plurality of light emitting diodes (LEDs) 146 are electrically connected to a power source 150, preferably in the form of batteries, as exemplified in FIG. 10.

In one embodiment, the decorative door wreath 100 further includes a second plurality of light emitting diodes (LEDs) disposed around a continuous inner surface 149 of the back annular support base 106, as illustrated in FIG. 9. The second plurality of light emitting diodes (LEDs) 147 are structurally similar to the first plurality of light emitting diodes (LEDs), except that the second plurality of light emitting diodes (LEDs) are fixed to the continuous inner surface 149 (as shown in FIG. 9) of the back annular support base 106, while the first plurality of light emitting diodes (LEDs) 146 are fixed to the continuous outer surface 148 of the back annular support base 106. Preferably, the second plurality of light emitting diodes (LEDs) 147 are electrically connected to the same power source (150, shown in FIG. 10) as the first plurality of light emitting diodes (LEDs) 146.

Figure 10:
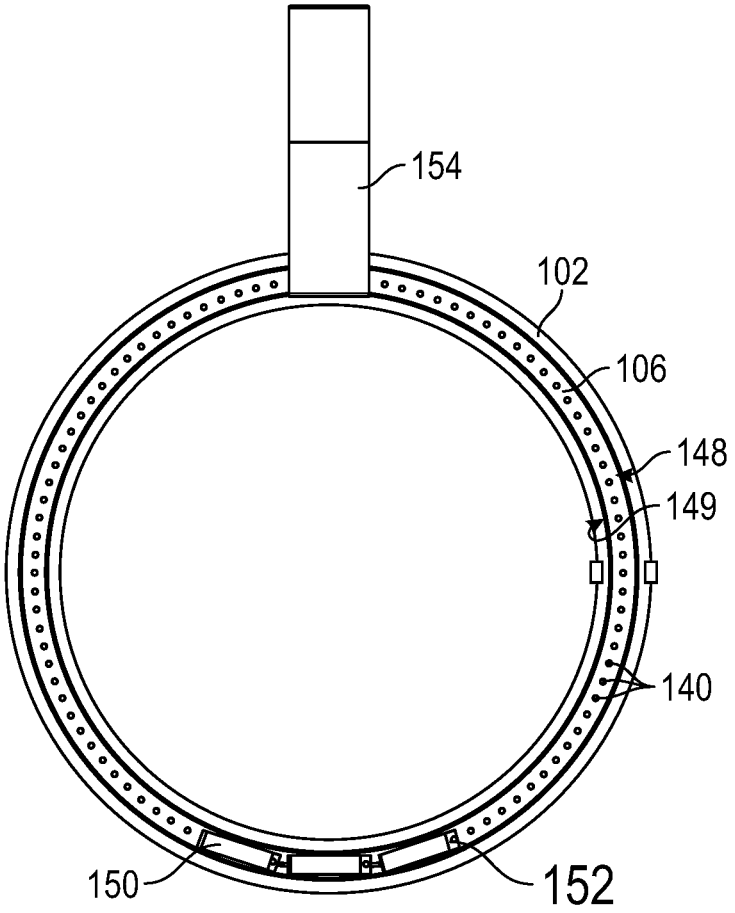
FIG. 10 is a rear view of the annular ring, in accordance with embodiments of the invention.

FIG. 10 illustrates a rear view of the annular ring 102. Preferably, the power source 150 is disposed within a recess 152 that is defined by the back annular support base 106, in accordance with a preferred embodiment of the invention. The power source 150 is preferably a battery such as AA Battery Cell, AAA Battery Cell, lithium batteries and the like. It would be readily apparent to those skilled in the art that various types of batteries for the power source 150 may be envisioned without deviating from the scope of the present invention.

Figure 11:
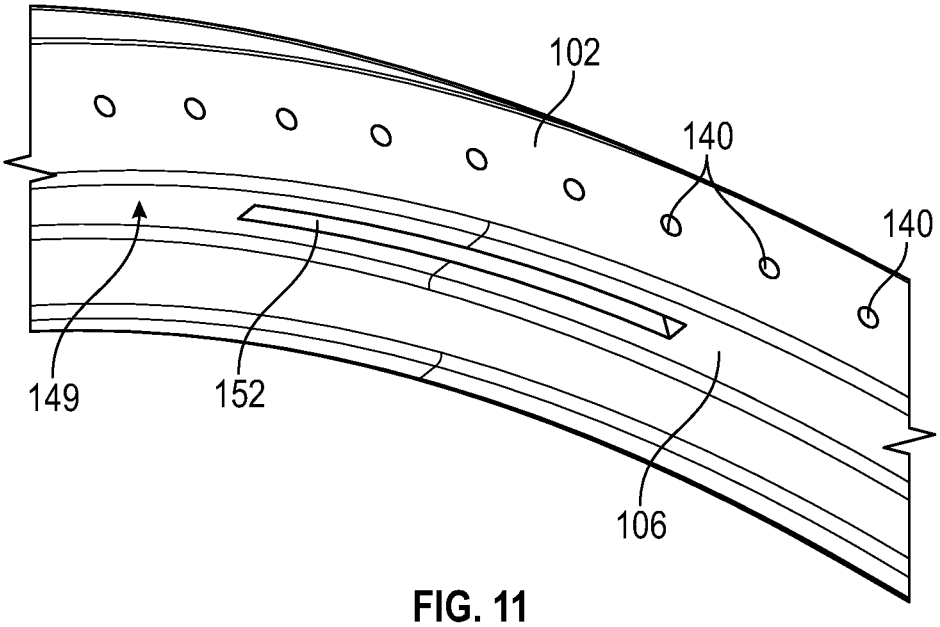
FIG. 11 is a rear perspective view of the annular ring with a recess, in accordance with embodiments of the invention.
Figure 12:
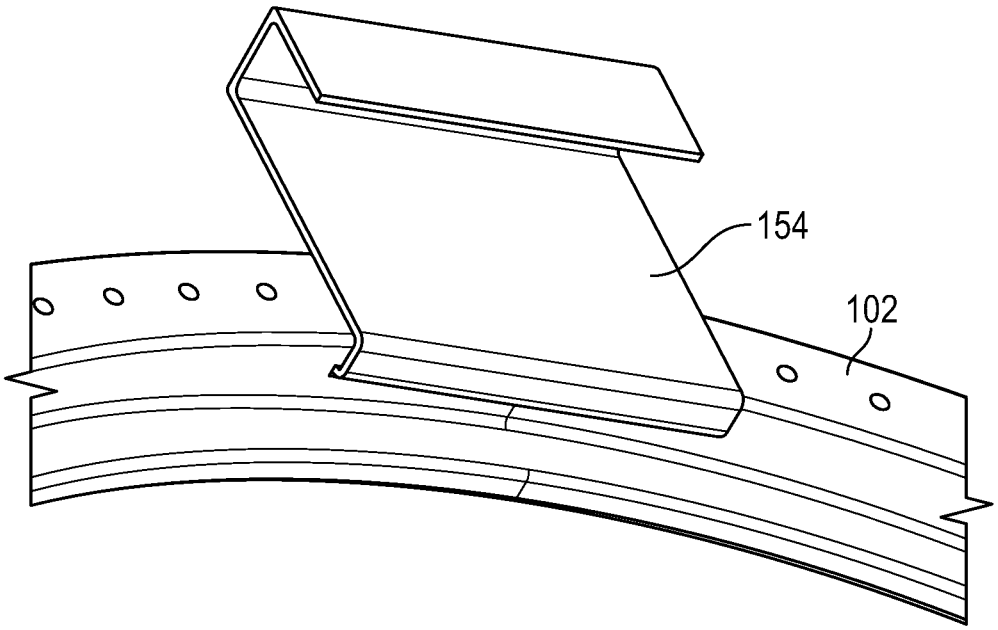
FIG. 12 is a rear perspective view of the annular ring and an exemplary hanger, in accordance with embodiments of the invention.
Figure 13:
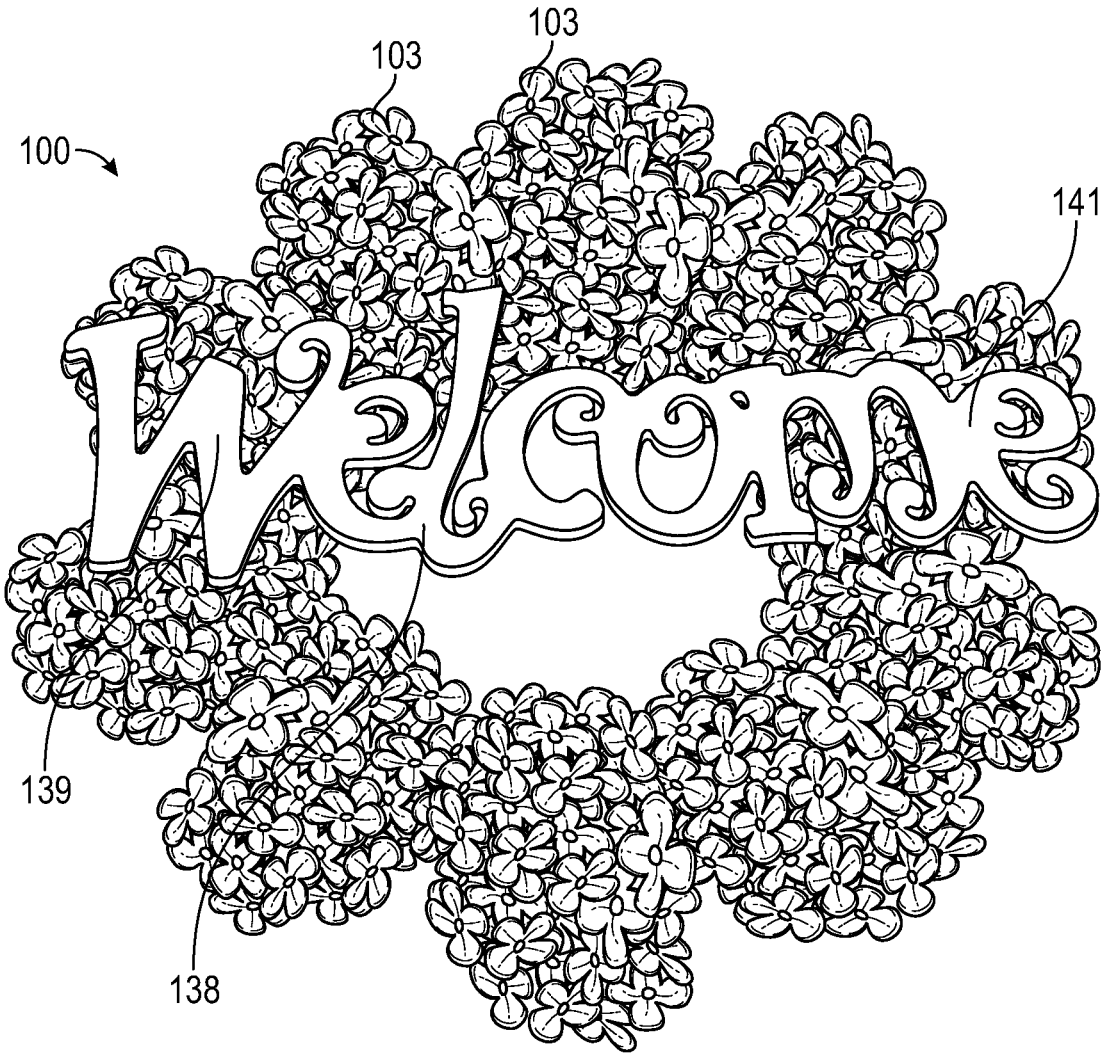
FIG. 13 is a front perspective view of a decorative door wreath, in accordance with embodiments of the invention.

FIG. 11-FIG. 12 provide bottom perspective views of the annular ring 102 with a hanger slot 152 defined by the back annular support base 106, which hanger slot 152 is sized and configured to receive a hanger 154, as shown in FIG. 12. The hanger 154 is utilized to hang the door wreath 100 on the door. The hanger includes a vertical arm 156 that is sized and configured to slide into the hanger slot 152, as defined by the back annular support base 106. From this disclosure, it would be readily apparent to those skilled in the art that various shapes and sizes of the hanger slot 152 may be envisioned to receive various shapes and sizes of the hanger 154, without deviating from the scope of the present invention.

FIG. 13 is a top perspective view of a decorative door wreath 100 in accordance with embodiments of the invention. As exemplified in FIG. 13, the at least first decorative ornament 103 (e.g., flowers) and the at least second decorative ornament 138 (e.g., Welcome sign) are attached to the annular ring 102 via the respective retention members, such as for example, retention members 114, 130.

Referring to FIGS. 1-13, the annual ring 102 is preferably constructed either of a thermoplastic material, a composite material, a metal, a metal alloy material, or a single piece of unitary construction.

As can be appreciated from the disclosure herein, embodiments of the present invention enable a user to interchangeably utilize multiple types of decorative ornaments, while maintaining the same decorative door wreath 100. Thus, embodiments disclosed herein obviate the need to own and store different door wreaths as well as obviate the costs of otherwise purchasing multiple wreaths. Embodiments of the disclosed invention allow the user to save certain costs of buying a new door wreath every time for a new occasion, because the user can easily interchange the desired decorative ornaments by removably connecting them to the decorative door wreath 100.

In some embodiments, product information and promotional information is preferably applied to the front surface 108 of the annular ring 102, as tailored to the user's desired marketing strategies. Advertising with the decorative door wreath 100 provides mechanisms to promote specific marketing initiatives, including promoting various services and festive wishes.

Except as may be expressly otherwise indicated, the article "a" or "an" if and as used herein is not intended to limit, and should not be construed as limiting, the description or a claim to a single element to which the article refers. Rather, the article "a" or "an" if and as used herein is intended to cover one or more such elements, unless the text expressly indicates otherwise.

The drawings and the forgoing description give examples of embodiments. Those skilled in the art will appreciate that one or more of the described elements may be very well combined into a single functional element. Alternatively, certain elements may be split into multiple functional elements. Elements from one embodiment may be added to another embodiment. For example, the orders of the processes described herein may be changed and are not limited to the manner described herein. Moreover, the actions of any flow diagram need not be implemented in the order shown; nor do all of the acts necessarily need to be performed.

Also, those acts that are not dependent on other acts may be performed in parallel with the other acts. The scope of embodiments is by no means limited by these specific examples. The components of the system including the devices and related technologies mentioned above are collectively used to improve performance of the insulated cap device.

Numerous variations, whether explicitly given in the specification or not, such as differences in structure, dimension, and use of material, are possible, based upon the disclosure provided herein. Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component of any or all the claims.

The claimed invention is:

1. A decorative door wreath comprising:

an annular ring comprising a front annular planar body and a back annular support base, the front annular planar body having a front surface disposed between a continuous inner edge opposite a continuous outer edge, said back annular support base having a smaller width than a width of the front annular planar body;

at least a first decorative ornament fixed to at least a first retention member comprising a first base plate and a first pair of resiliently flexible spring arms removably connected to the front surface of the front annular planar body, wherein the first pair of resiliently flexible spring arms are configured to flex laterally away from each other in opposing directions to provide for passage of at least a first portion of the front annular planar body therebetween and then retract back into position so as to contract around the continuous inner edge and the continuous outer edge of the at least first portion of the front surface of the annular ring, so that the at least first decorative ornament extends frontally from said annular ring while the at least first decorative ornament is detachably coupled to and retained by the annular ring.

2. The decorative door wreath of claim 1, wherein the first base plate of the at least first retention member comprises a rectangular planar body.

3. The decorative door wreath of claim 1, wherein the first base plate of the at least first retention member comprises a round planar body.

4. The decorative door wreath of claim 1, wherein each resiliently flexible spring arm of the first pair of resiliently flexible spring arms comprises a planar body extending outwardly transverse from the first base plate of the at least first retention member, wherein each resiliently flexible spring arm has a distal end comprising an inwardly facing protuberance adapted to contract around the continuous inner edge and the continuous outer edge of the at least second portion of the front surface of the annular ring.

5. The decorative door wreath of claim 1, said at least first decorative ornament fixed to at least a second retention member comprising a second base plate and a second pair of resiliently flexible spring arms removably connected to the front surface of the front annular planar body, wherein the second pair of resiliently flexible spring arms are configured to flex laterally away from each other in opposing directions to provide for passage of at least a second portion of the front annular planar body therebetween and then retract back into position so as to contract around the continuous inner edge and the continuous outer edge of the at least second portion of the front surface of the annular ring, so that the at least first decorative ornament extends frontally from said annular ring while the at least first decorative ornament is detachably coupled to and retained by the annular ring.

6. The decorative door wreath of claim 5, wherein the first portion of the front surface of the annular ring is disposed on an opposite side of the annular ring than the second portion of the front surface of the annular ring.

7. The decorative door wreath of claim 5, wherein the at least first decorative ornament is molded in the shape of a seasonal signage comprising a display of at least one word.

8. The decorative door wreath of claim 1, wherein said first decorative ornament is constructed in the shape of a flower.

9. The decorative door wreath of claim 1, wherein the at least first decorative ornament is molded in the shape of a logo, a mascot, or a name of a school or of a team.

10. The decorative door wreath of claim 1, further comprising at least a second decorative ornament fixed to at least a third retention member comprising a third base plate and a third pair of resiliently flexible spring arms removably connected to the front surface of the front annular planar body, wherein the third pair of resiliently flexible spring arms are configured to flex laterally away from each other in opposing directions to provide for passage of at least a third portion of the front annular planar body therebetween and then retract back into position so as to contract around the continuous inner edge and the continuous outer edge of the at least third portion of the front surface of the annular ring, so that the at least second decorative ornament extends frontally from said annular ring while the at least second decorative ornament is detachably coupled to and retained by the annular ring.

11. The decorative door wreath of claim 1, wherein said annular ring defines at least a first plurality of mounting apertures in a spaced-relationship with respect to each other around a circumference of the annular ring, wherein each mounting aperture is adapted to receive a bendable wire frame of at least one wire frame mounted decorative ornament.

12. The decorative door wreath of claim 11, further comprising at least one wire frame mounted decorative ornament fixed to a bendable wire frame, said bendable wire frame removably connected to the planar annular ring, wherein said bendable wire frame is removably disposed through at least one mounting aperture of the at least first plurality of mounting apertures of the annular ring.

13. The decorative door wreath of claim 1, further comprising a first plurality of light emitting diodes (LEDs) disposed around a continuous outer surface of the back annular support base, the first plurality of light emitting diodes (LEDs) electrically connected to a power source.

14. The decorative door wreath of claim 13, wherein the power source is a battery disposed within a recess defined by the back annular support base.

15. The decorative door wreath of claim 1, further comprising a second plurality of light emitting diodes (LEDs) disposed around a continuous inner surface of the back annular support base, the second plurality of light emitting diodes (LEDs) electrically connected to a power source.

16. The decorative door wreath of claim 15, wherein the power source is a battery disposed within a recess defined by the back annular support base.

17. The decorative door wreath of claim 1, wherein the annular ring is made of a thermoplastic material.

18. The decorative door wreath of claim 1, wherein the annular ring is made of a composite material.

19. The decorative door wreath of claim 1, wherein the annular ring is a metal.

20. The decorative door wreath of claim 1, wherein the annular ring is a metal alloy material.

21. The decorative door wreath of claim 1, wherein said annular ring is a single piece of unitary construction.

22. The decorative door wreath of claim 1, further comprising a hanger adapted to removably connect to a door, said hanger comprising a vertical arm sized and configured slidingly engage a hanger slot defined by the back annular support base.

23. The decorative door wreath of claim 1, wherein said back annular support base defines a hanger slot adapted to receive a hanger.

* * * * *